US005496612A

United States Patent [19]

Ransbottom

[11] Patent Number: 5,496,612

[45] Date of Patent: Mar. 5, 1996

[54] SHOE ADORNMENT

[75] Inventor: Jayne M. Ransbottom, Chatsworth, Calif.

[73] Assignee: J. J. Moods, Inc., Chatsworth, Calif.

[21] Appl. No.: 422,788

[22] Filed: Apr. 17, 1995

[51] Int. Cl.[6] ..... A43B 23/24

[52] U.S. Cl. ..... 428/99; 428/7; 428/24; 2/245; 36/136

[58] Field of Search ..... 428/99, 7, 24; 2/245; 36/136

[56] References Cited

U.S. PATENT DOCUMENTS 2,587,205 2/1952 Paster ..... 2/245

*Primary Examiner*—Alexander S. Thomas

*Attorney, Agent, or Firm*—Jack C. Munro

[57] ABSTRACT

A shoe adornment in the form of a thin sheet-like base to which is mounted on the lower surface thereof an elastic band. On the upper surface of the base is mounted an ornament. The elastic band is to be secured around the ball area of a human foot and upon the foot being inserted into a shoe, the base can be deformed to be in juxtaposition with the shape of the shoe in the area of the throat of the shoe, thereby giving the appearance that the ornament is mounted on the shoe itself.

9 Claims, 1 Drawing Sheet

SHOE ADORNMENT

REFERENCE TO DISCLOSURE DOCUMENT

The subject matter of this invention was submitted in a disclosure document No. 351769 which was received in the United States Patent Office on Apr. 8, 1994.

BACKGROUND OF THE INVENTION

1) Field of the Invention

The field of this invention has to do with adornments and more particularly to an adornment for a shoe and particularly a women's shoe.

2) Description of the Prior Art

In constructing of women's shoes it is common to locate some type of ornamentation on the shoe. The ornamentation is frequently located at the throat of the shoe. If the ornamentation were to be removed, the shoe would have a basic plain configuration. It is common to sell plain configured shoes.

Generally ornamented shoes are substantially more expensive than the plain shoes. If a woman works in a workplace, normally the woman would wear a plain shoe. After work, if the woman might go to dinner and dancing, the woman may be inclined to change shoes to a more ornamented shoe. Ornamented shoes are substantially more expensive than plain shoes, with it being common that such shoes cost several hundred dollars. Also a woman would not just have one pair of ornamented shoes, but would obviously have to have several different types. Therefore, the acquiring of ornamented shoes is expensive for most women.

SUMMARY OF THE INVENTION

The primary objective of the present invention is to construct an adornment that can be worn by a woman in conjunction with a plain type shoe which transforms that plain type shoe into an ornamented shoe.

Another objective of the present invention is to be able to have the user wear a plurality of different adornments with the plain type of shoe which will give the appearance of being several different types of shoes when in fact it is only a single plain type of shoe.

Another objective of the present invention is to construct a shoe adornment which can be easily and quickly installed and once installed will remain in position for as long as the shoe adornment is worn.

Another objective of the present invention is to construct a shoe adornment which can be constructed in a wide variety of different configurations.

The shoe adornment of the present invention is constructed of a sheet-like base which is malleable so as to be deformable from an installing position to an installed position. Attached to the undersurface of the base is an elastic band. Mounted on the upper surface of the base is an ornament. The elastic band is to be slipped onto the user's foot in the area of the ball of the foot with the ornament facing in the upward direction. The user's foot is then slid into a shoe with the base being located directly adjacent the throat of the shoe. The user then physically deforms the base to a position against the surface of the shoe at which position the base will remain for as long as the shoe and adornment are worn.

DETAILED DESCRIPTION OF THE PREFERRED EMBODIMENT

Figure 4:
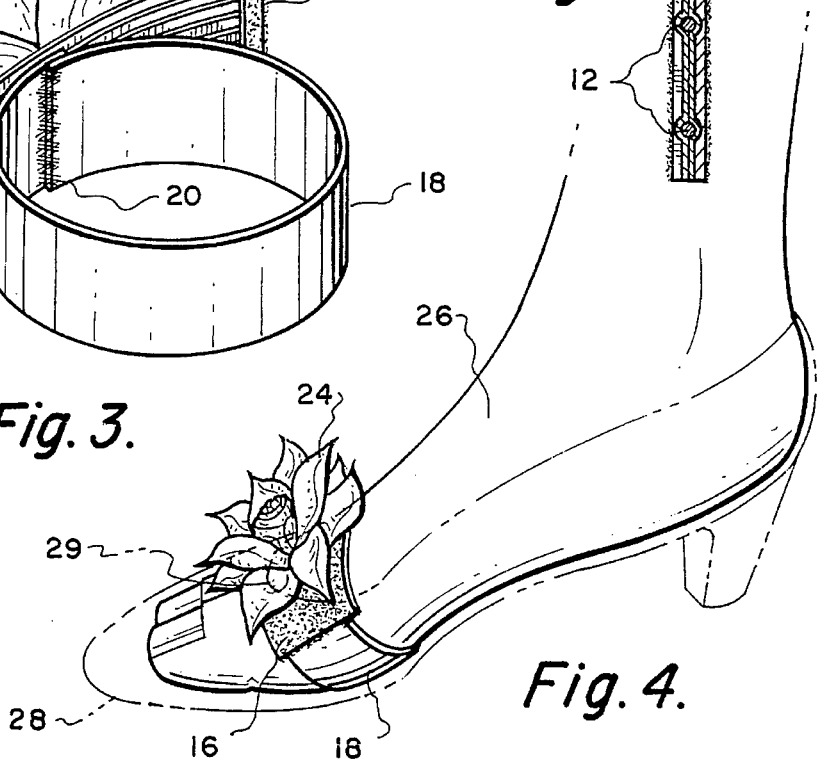
FIG. 4 is an isometric view depicting mounting of the shoe adornment on a human foot in conjunction with a shoe.

Referring particularly to the drawing there is shown in FIG. 4 a conventional shoe 28 which has a throat 29. The throat comprises the portion of the vamp that is located at the access opening of the shoe into which the foot 26 is to be inserted.

An elastic band 18 is to be inserted around the foot 26 in the area of the ball of the foot. The elastic band 18 generally will comprise a one inch wide elastic material that is stitched together forming a seam 20. The length of the band 18 will generally be about eight inches. When the elastic band 18 is at rest, the band 18 will have a diameter of about two and one-half inches. The band 18 will enclose an area 19 and it is into this area 19 that the foot 26 will be located. It is to be understood that the band 18 will be stretched as it is inserted over the foot 26 and then when released, will automatically form a snug fit with the foot 26.

At the seam 20 there is secured to the band 18 a base 10. The band 18 is to be secured to the undersurface of the base 10. The base 10 is constructed of abutting layers of a sheet material 14 with a plurality of fine gauge metallic wires 12 running lengthwise the entire length of the base 10. The base 10 will normally be about four and one-half inches long and one and one-half inches wide. The typical diameter for the wires 12 would be about 1/64 of an inch.

Figure 1:
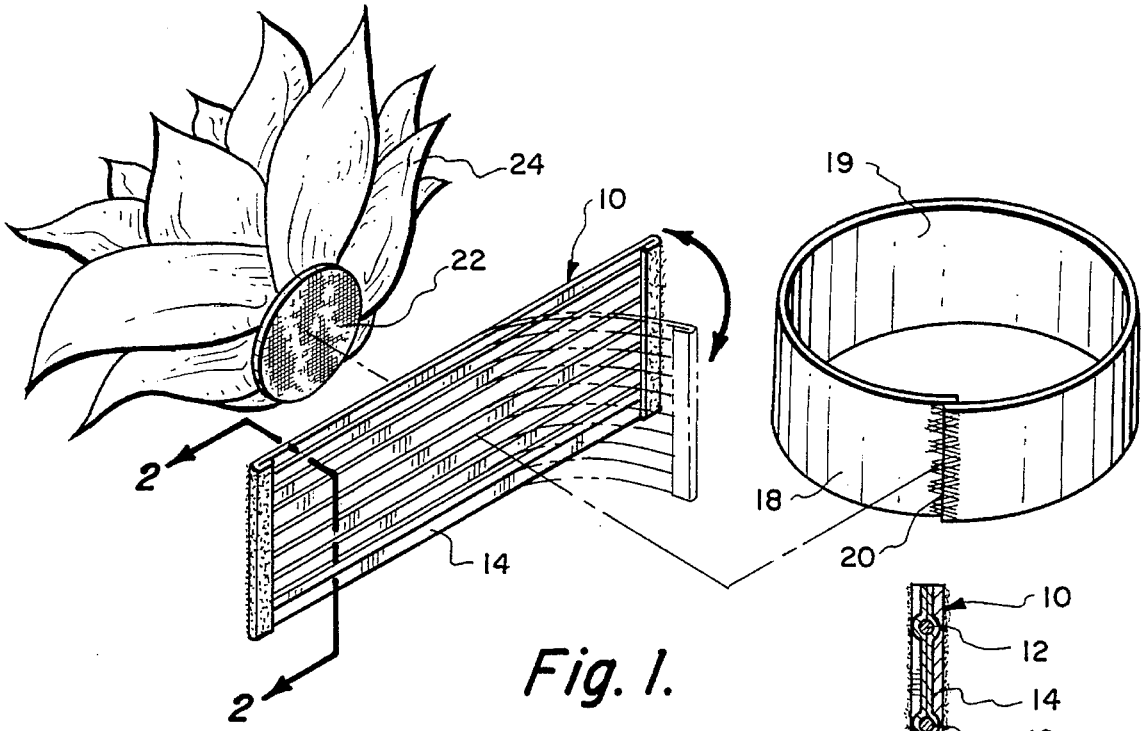
FIG. 1 is an exploded isometric view of the shoe adornment of the present invention.
Figure 2:
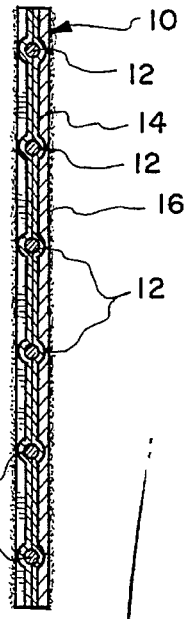
FIG. 2 is a cross-sectional view through the base included within the shoe adornment of the present invention taken along line 2—2 of FIG. 1.

The wires 12 are evenly spaced apart across the width of the base 10. Typical structure for the sheet material layers 14 would be a paper, although a plastic could also be used. Because of the addition of the wires between the paper layers 14, the base 10 becomes malleable. Malleable is being defined as being easily manually movable to a deformed or deflected position and will remain in that position until manually moved to another position. The deflection of the base 10 is depicted in dotted lines in FIG. 1 of the drawings. It is to be understood that the base 10 could be constructed in another manner, such as by being composed of a single piece of malleable material such as sheet aluminum.

The base 10 is then covered with a fabric layer 16 on its upper surface. The fabric layer 16 overlaps the ends of the base 10. It is noted that there are six in number of the wires 12 being shown within the base 10. However, this number can be increased or decreased without departing from the scope of this invention. It is to be understood that the base 10 could be covered with any desirable type of fabric 16. The purpose of the fabric 16 is to provide a more attractive appearance for the upper layer of the base 10.

An ornament 24 includes an attachment disk 22. The attachment disk 22 is to be adhesively secured to the upper surface of the base 10 directly onto the fabric layer 16. Normally this securement will be at the longitudinal midpoint of the base 10. Also the securement of the band 20 is at the longitudinal midpoint of the base 10. It is to be understood that the base 10 could be secured to numerous different configurations of ornaments 24 with the particular ornament 24 being shown is a flower. Other types of ornaments could be bows, beaded fringe, jewels, feathers, buckles, braids and so forth.

Figure 3:
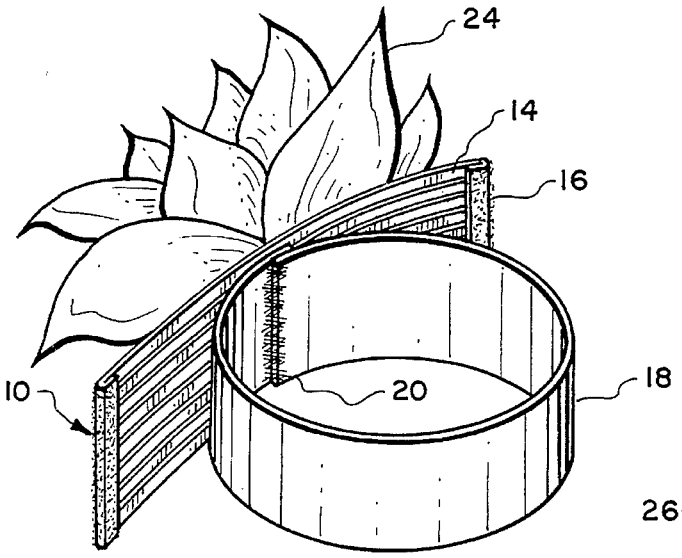
FIG. 3 is an isometric view of the completely assembled shoe adornment of the present invention.

The operation of the shoe adornment of the present invention is as follows: The user is to take the adornment and insert a foot into enclosed area 19 and locate the ornament 24 so that it is against the top of the foot 26. The position of the elastic band is in the area of the ball of the foot. When in this position, which is deemed to be the installing position, the base 10 is substantially planer and assumes the position as shown in FIG. 3. The reason for this is that during placement of the foot 26 within the shoe 28, base 10 will not interfere with the placement of the foot 26. Once the shoe 28 has been correctly installed in conjunction with the foot 26, the band 18 and the base 10 are adjusted to just overlap the throat 29 of the shoe 28. The user then will deflect or deform the base 10 so that along the entire longitudinal length of the base 10 it will rest against the upper surface of the shoe 28 on either side of the throat 29. This will give the appearance that the shoe adornment is actually part of the shoe 28 and is not a separate item when it is worn.

It is to be understood that there will be two shoe adornments worn at the same time, one on each foot. It is also to be understood that the user may disconnect the foot 26 from the shoe 28 and remove the shoe adornment whenever desired. The user can in turn replace the shoe adornment with a separate adornment or wear the shoe 28 without a shoe adornment.

What is claimed is:

1. A shoe adornment comprising:

a base, said base having an upper surface and a lower surface, said base being malleable, said base being deformable from an installing position to an installed position;

a band attached to said lower surface of said base, said band adapted to be mounted about the foot of a human;

an ornament secured to said upper surface of said base; and whereby after mounting of said band on a foot, the foot is inserted within a shoe with said ornament being positioned directly adjacent the throat of the shoe constituting said installing position of said base, whereby said base is to be deformed to be located against the throat and assume substantially the transverse arcuate shape of the shoe across the throat constituting said installed position.

2. The shoe adornment as defined in claim 1 wherein:

said band being elastic.

3. The shoe adornment as defined in claim 1 wherein:

said band being attached to said lower surface of said base substantially at the longitudinal midpoint of said base.

4. The shoe adornment as defined in claim 1 wherein:

said ornament being secured to upper surface of said base substantially at the longitudinal midpoint of said base.

5. The shoe adornment as defined in claim 1 wherein:

said base being constructed of a plurality of metallic wires imbedded between thin layers of a sheet material.

6. The shoe adornment as defined in claim 5 wherein:

said sheet material comprising paper.

7. The shoe adornment as defined in claim 5 wherein:

said band being elastic.

8. The shoe adornment as defined in claim 7 wherein:

said band being attached to said lower surface of said base substantially at the longitudinal midpoint of said base.

9. The shoe adornment as defined in claim 8 wherein:

said ornament being secured to upper surface of said base substantially at the longitudinal midpoint of said base.

* * * * *